US006186863B1

(12) United States Patent
Kim

(10) Patent No.: US 6,186,863 B1
(45) Date of Patent: Feb. 13, 2001

(54) STRING ADJUSTER IN BRASSIERE/BODY SUIT

(76) Inventor: Park Kim, 301 Symphony House, 5/4 66-1, Samsung-Dong, Kangnam-Gu, Seoul (KR)

( * ) Notice: Under 35 U.S.C. 154(b), the term of this patent shall be extended for 0 days.

(21) Appl. No.: 09/571,745

(22) Filed: May 15, 2000

(30) Foreign Application Priority Data

Mar. 10, 2000 (KR) ..... 2000-6790

(51) Int. Cl.[7] ..... A41C 3/00
(52) U.S. Cl. ..... 450/86; 450/1; 450/7
(58) Field of Search ..... 450/58, 7, 1, 8, 450/30, 32, 80, 83, 84, 85, 82, 86; 2/73, 67, 311–323, 326, 336, 333, 334, 338; 24/198, 200

(56) References Cited

U.S. PATENT DOCUMENTS

D. 253,320 11/1979 Adams .
4,204,300 5/1980 Fildan .
4,953,233 9/1990 Moshier .
5,060,348 10/1991 Moshier .
5,848,454 * 12/1998 Kojima ..... 24/200
5,899,791 5/1999 Fildan .

* cited by examiner

*Primary Examiner*—Gloria M. Hale
(74) *Attorney, Agent, or Firm*—Jacobson, Price, Holman & Stern, PLLC

(57) ABSTRACT

Disclosed is a string adjuster in brassiere and body suit, which connects the brassiere and the body suit together through one string. The string adjuster includes a fixing hole, which is formed at the upper portion thereof and fixed at a front end of the string adjusting portion, and first and second hooked holes which are formed under the fixing hole and have an open end for inserting and hooking loops of the brassiere and the body suit. The above structure of the string adjuster provides good sense of wear and prevents the connected portion from projecting.

2 Claims, 5 Drawing Sheets

STRING ADJUSTER IN BRASSIERE/BODY SUIT

BACKGROUND OF THE INVENTION

1. Field of the Invention

The present invention relates to a string adjuster used for lingerie, and more particularly, to a string adjuster in brassiere and body suit put on a woman's upper body.

2. Description of the Related Art

As shown in FIG. 1, brassiere 10 has a pair of cups 11 arranged side by side for wrapping a woman's breasts, both ends of the cups 11 extending in a predetermined length to be fastened on her back. Body suit 20 is in the one-piece form to resiliently wrap generally from the hypogastric region to the breast. It is a matter of individual preference, but commonly, the brassiere 10 is worn directly on the body, and then, the body suit 20 is worn over the brassiere 10.

The brassiere 10 and the body suit 20 worn one over the other on the woman's upper body have a pair of shoulder strings, which are placed on both shoulders to prevent the brassiere and the body suit from slipping down. Seeing a structure of the typical string adjuster, as shown in FIG. 2, two shoulder strings 30 and 30' are respectively connected to loops of the brassiere 10 and the body suit 20 through string adjusters R and R' of a ring shape at both sides of the front part of the brassiere 10 and the body suit 20.

However, because the brassiere 10 and the body suit 20 have respectively the shoulder strings 30 and 30' and the string adjusters R and R', two strings 30 and 30' lie one upon the other when a user wears the brassiere 10 and the body suit 20. At this time, pressure is increased and presses the user's shoulders severely, thereby causing pain in the shoulders. Especially, women who have big breasts feel the pain more severely.

Furthermore, in the location where two string adjusters R and R' are overlapped, four strings are overlapped. Therefore, the location of the string adjusters is remarkably projected though the user puts on a blouse over the body suit, thereby making the user's appearance unseemly.

SUMMARY OF THE INVENTION

It is, therefore, an object of the present invention to provide a string adjuster in brassiere and body suit, which connects the brassiere and the body suit together with only one string to prevent pressure on shoulders and to prevent the connected portion from severely projecting.

To accomplish the above object, the present invention provides a string adjuster comprising a fixing hole which is formed at the upper portion thereof and fixed at a front end of a string adjusting portion and first and second hooked holes which are formed under the fixing hole and have an open end for hooking loops of the brassiere and the body suit.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described hereinafter with reference to the accompanying drawings. In the following description, well-known functions or constructions are not described in detail since they would obscure the invention in unnecessary detail.

Figure 1:
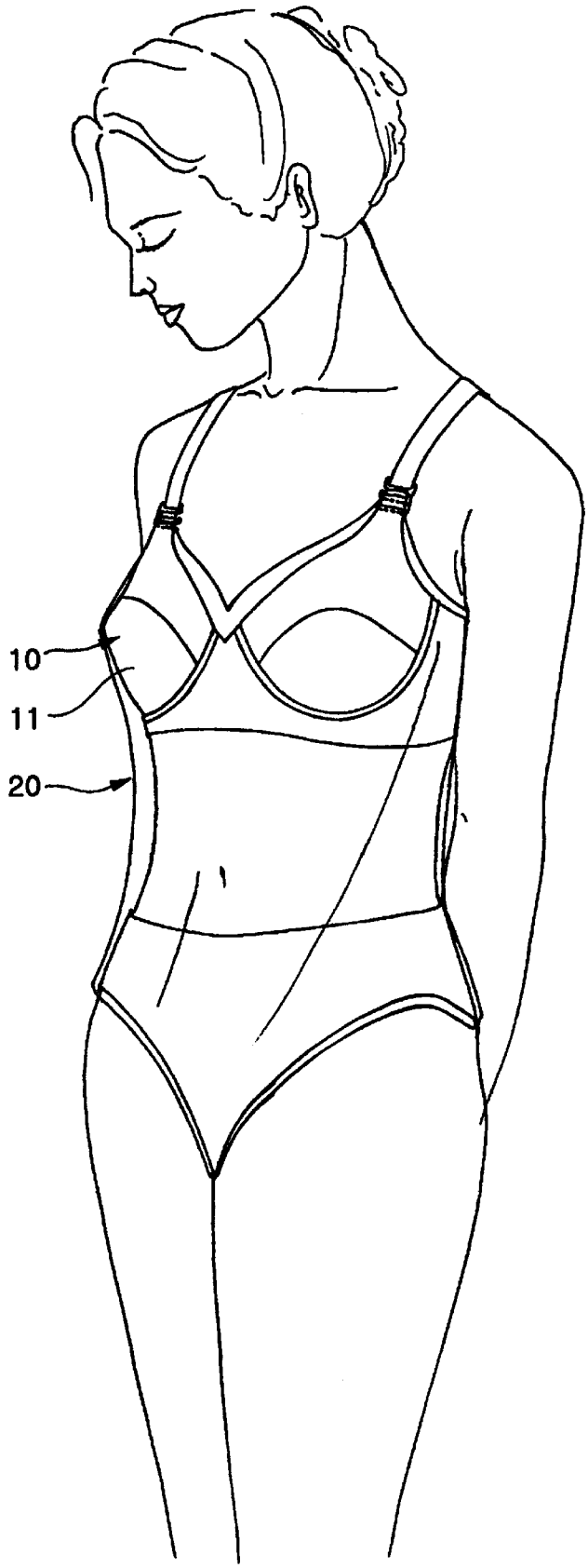
FIG. 1 is a perspective view showing a state that a user puts on a brassiere and a body suit using this invention.
Figure 2:
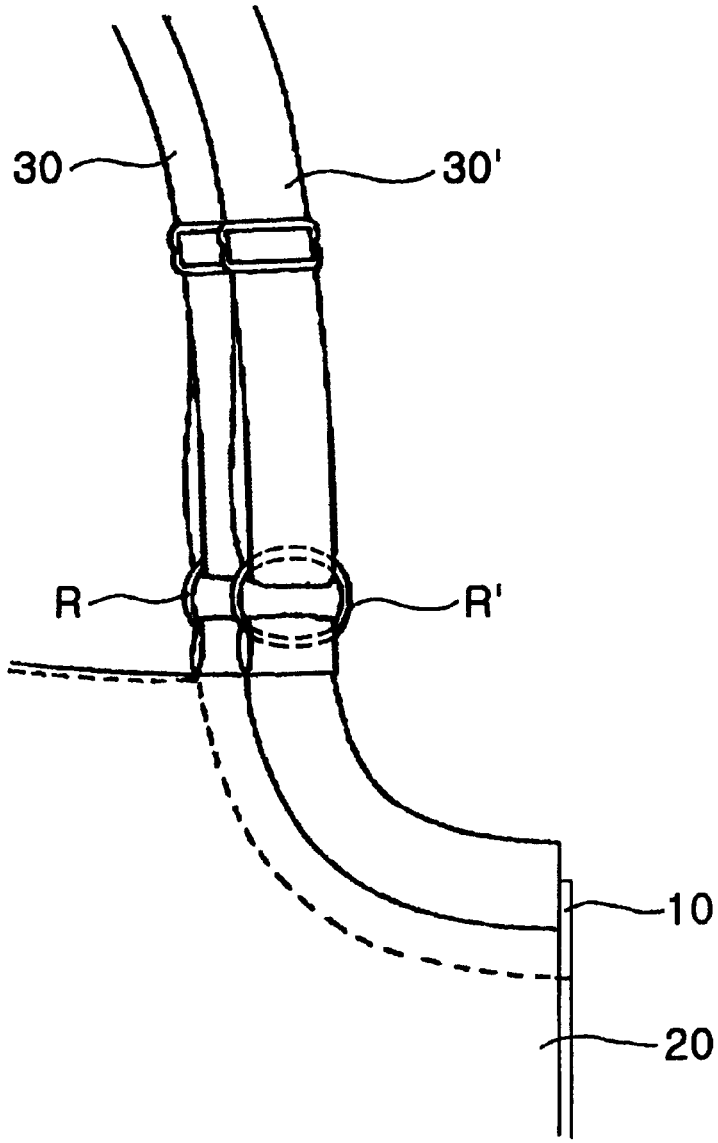
FIG. 2 is a front view showing a connected state of shoulder strings of typical brassiere and body suit.
Figure 3:
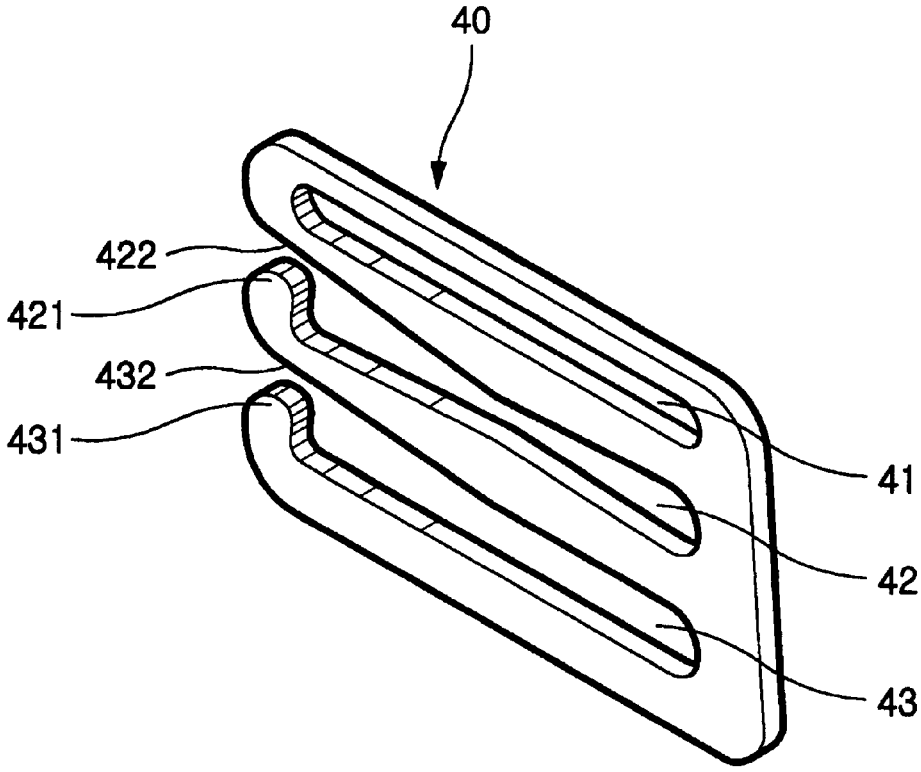
FIG. 3 is a perspective view of a string adjuster of the present invention.
Figure 4A:
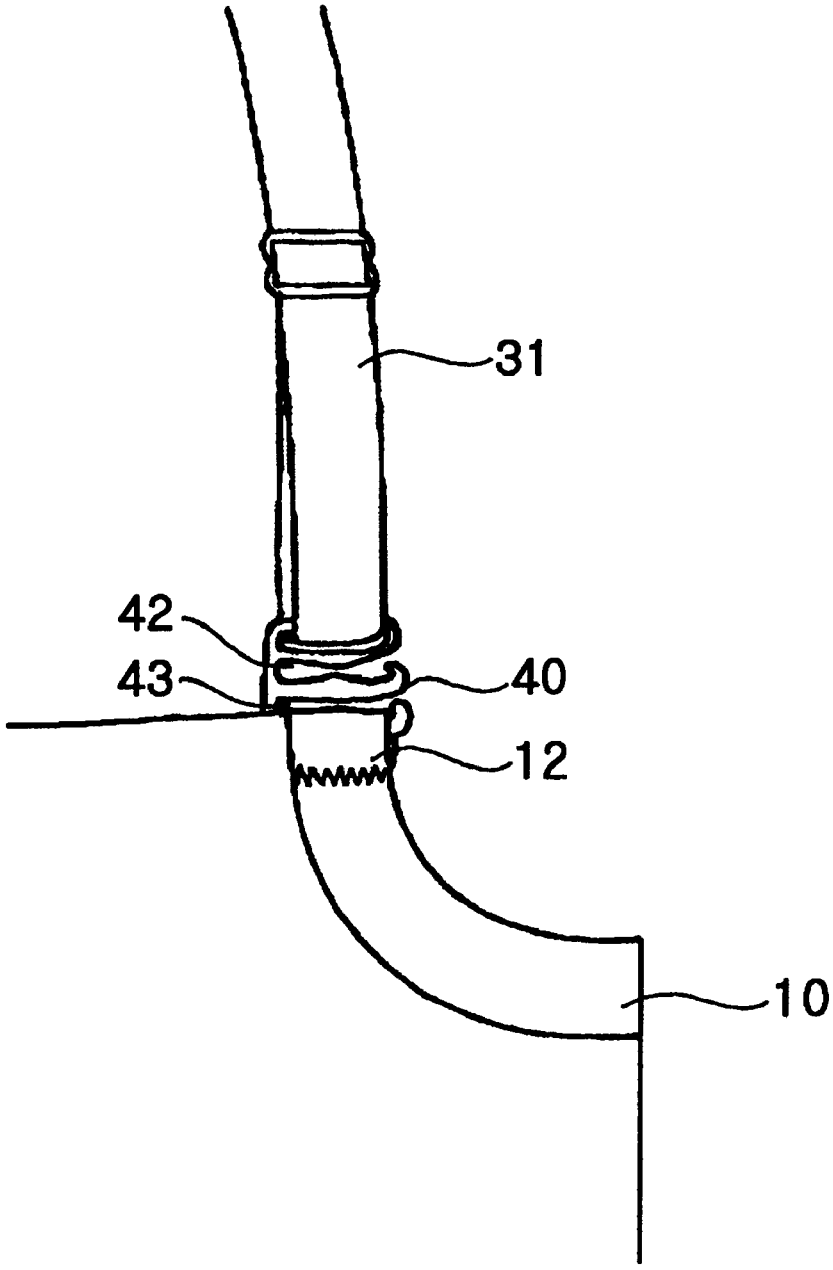
FIGS. 4*a* and 4*b* are front views showing a connected state of shoulder strings of the brassiere and the body suit according to the present invention.
Figure 4B:
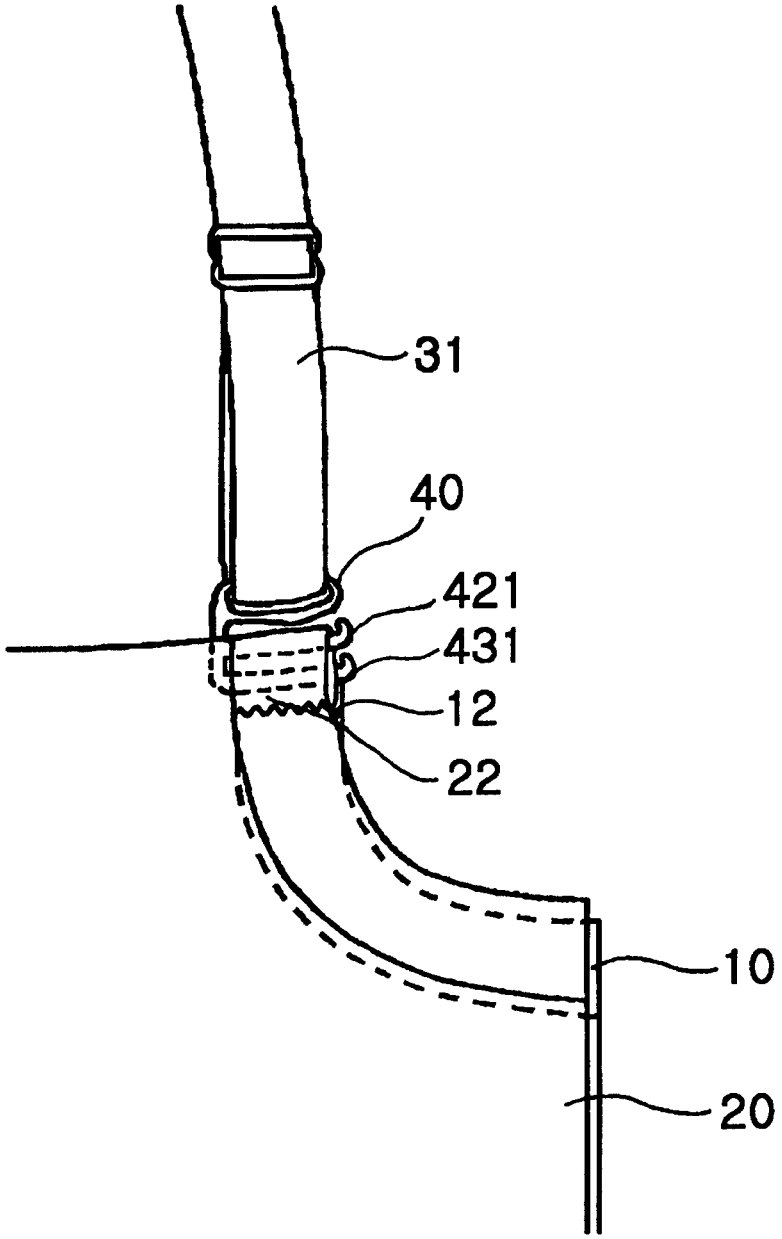

FIG. 1 is a perspective view showing a state that a user puts on a brassiere and a body suit using this invention. FIG. 3 is a perspective view of a string adjuster of the present invention and FIGS. 4*a* and 4*b* are front views showing a connected state of shoulder strings of the brassiere and the body suit according to the present invention.

In a preferred embodiment, a brassiere 10, which this invention is applied to, includes a pair of cups 11 arranged side by side for wrapping a woman's breasts, and a pair of loops 12 disposed at the upper center of the cups 11 for connecting to shoulder strings 30, opposite side ends of the cups 11 extending in a predetermined length to be fastened on her back with each other. A body suit 20 is in the one-piece form to wrap from the hypogastric region to the breast. The body suit 20 also has a pair of loops 22 disposed at the same location as the loops 12 of the brassiere for connecting to the shoulder strings. Alternatively, the loops of the brassiere and the body suit can be disposed at the corresponding position of the user's back and connected to shoulder strings extending from the breast portion. In another way, the loops can be located at the breast portion and the back portion and they are connected with each other through a separate shoulder string. The shoulder strings applied to the brassiere and the body suit can be adjusted in length to fit to the user's body type.

The shoulder string and the loop are connected with each other through a string adjuster 40. The string adjuster 40 according to the present invention includes a fixing hole 41 fixed at a front end of a string adjusting portion of the brassiere and the body suit and first and second hooked holes 42 and 43, which have an open end for hooking the loops 12 and 22 of the brassiere 10 and the body suit 20. The string adjuster 40 will be described hereinafter in more detail.

The string adjuster 40, which is made of thin metal or thin board of synthetic resin, as shown in FIG. 3, includes the fixing hole 41 laterally extending at the upper portion of the thin board, the first hooked hole 42 which is formed under the fixing hole 41 and has a first hooked projection 421, and the second hooked hole 43 which is formed under the first hooked hole 42 and has a second hooked projection 431. First and second guide surfaces 422 and 432, which slant at a predetermined angle, are arranged at the corresponding surfaces of the first and second hooked projections 421 and 431.

A process for connecting the brassiere 10 and the body suit 20 with one shoulder string 30, which is formed on the body suit 20, through the string adjuster 40 will be described hereinafter.

In case that the user wears the brassiere 10 and the body suit 20, after putting on the brassiere 10 and the body suit 20 in order, the user inserts and fastens the fixing hole 41 into the front end of the string adjusting portion 31 of the body suit 20.

As shown in FIG. 4*a*, the loop 12 of the brassiere 10 is hooked and connected to the second hooked hole 43 of the string adjuster 40 fastened to the string adjusting portion 31. After that, as shown in FIG. 4*b*, the loop 22 of the body suit 20 is hooked and connected to the first hooked hole 42. At this time, the loops 12 and 22 are easily inserted into the hooked holes 42 and 43 passing along the guide surfaces 422 and 432. After the loops are inserted, they are not separated from the hooked holes 42 and 43 by the hooked projections 421 and 431. In case that the user wears the brassiere 10 after wearing the body suit 20, first, the loop 22 of the body suit 20 is inserted into the second hooked hole 43, and then, the loop 12 of the brassiere 10 is inserted into the first hooked hole 42.

Meanwhile, in case that the user wears either the brassiere 10 or the body suit 20, the loop can be inserted one of the first and second hooked holes 42 and 43.

As described above, the string adjuster according to the present invention includes the fixing hole which is formed at the upper portion and fixed at the front end of the string adjusting portion and two hooked holes which are formed under the fixing hole and have the open end for hooking the loops of the brassiere and the body suit. By the above structure of the string adjuster, the brassiere and the body suit can be connected to one shoulder string together, thereby providing good sense of wear and preventing the connected portion from projecting.

While the invention has been shown and described with reference to a certain referred embodiment thereof, it will be understood by those skilled in the art that various changes in form and details may be made therein without departing from the spirit and scope of the invention as defined by the appended claims.

What is claimed is:

1. A string adjuster in brassiere and body suit, which connects the brassiere and the body suit together through one string, comprising:

a fixing hole formed at an upper portion of the adjuster, the fixing hole being fixed on a front end of a string adjusting portion of a shoulder string; and first and second hooked holes formed under the fixing hole for hooking loops of the brassiere and the body suit, each hooked hole having an open end, the second hooked hole being formed under the first hooked hole.

2. A string adjuster as claimed in claim 1, wherein the string adjuster further includes first and second hooked projections formed at an open end portion of the first and second hooked holes, and first and second guide surfaces which slant outwardly at a predetermined angle on corresponding surfaces of the first and second hooked projections.

* * * * *